US006048121A

United States Patent [19]

Carver

[11] Patent Number: 6,048,121

[45] Date of Patent: Apr. 11, 2000

[54] DRY MARKER AND ERASER SYSTEM

[75] Inventor: James W. Carver, Affton, Mo.

[73] Assignee: Cliperase, L.L.C., Webster Groves, Mo.

[21] Appl. No.: 09/022,966

[22] Filed: Feb. 12, 1998

[51] Int. Cl.[7] ..... B43K 25/00

[52] U.S. Cl. ..... 401/52; 401/195

[58] Field of Search ..... 401/52, 195, 131, 401/198, 199; 15/424, 426, 427, 428

[56] References Cited

U.S. PATENT DOCUMENTS

| | | | |
|---|---|---|---|
| 2,142,761 | 1/1939 | Quinn | 197/181 |
| 3,941,488 | 3/1976 | Maxwell | 401/17 |
| 5,072,483 | 12/1991 | Durand | 401/131 |
| 5,131,112 | 7/1992 | Cervini | 15/209.1 |
| 5,432,973 | 7/1995 | Wagner et al. | 401/52 |

OTHER PUBLICATIONS

3M "Designer's Reference Guide to Adhesive Technology," 1995, pp. 1–36.

Catalog 526, Title E: "Disposable Erasermate 2" .

Pull out from Pacific States Felt & Mfg. Co., Inc., "Felt Products and Gasket Materials," pp. 1–2.

Pacific States Felt & Mfg. Co., Inc. brochure, pp. 1–4.

*Primary Examiner*—David J. Walczak

*Attorney, Agent, or Firm*—Senniger, Powers, Leavitt & Roedel

[57] ABSTRACT

An improved dry marker and eraser system includes a dry marker having a marker end for marking and a butt end opposite the marker end. The system also includes a plastic cap having an open end, a solid top spaced from the open end, and a solid sidewall between the open end and the solid top. An eraser is secured to the solid top or solid sidewall of the plastic cap. The eraser is adapted for erasing dry erase markings. The sidewall of the cap has an internal surface dimensioned to engage the marker end of the dry marker through the open end of the cap to protect the marker end from drying out when the dry marker is not in use. The cap also engages the butt end of the dry marker to store the cap when the dry marker is in use. An elongated eraser can be secured along the marker body between the marker end and the butt end of the dry marker. A clip can also securely hold a dry erase eraser to a dry marker.

12 Claims, 3 Drawing Sheets

DRY MARKER AND ERASER SYSTEM

BACKGROUND OF THE INVENTION

Dry markers have been in use for many years to mark on white boards with several different colors of marker. Large hand-held felt erasers of a size similar to conventional chalkboard erasers are commonly supplied for use with dry markers in cleaning the dry markings off of the white board after it has been marked up to clear the white board for another set of markings.

A problem with the prior apparatus is that a user often needs to erase only a small portion of a marking on a white board. The conventional erasers are often too big to be of assistance in accurately erasing small areas without erasing nearby markings which are intended to remain on the white board. Another problem with the prior apparatus is that the large, hand-held erasers are often lost or else located a distance away from the user's immediate location when a small erasure is needed.

As a result of the aforesaid problems, the user frequently uses his or her finger to make small erasures on the white board. While this finger technique is effective for erasing, it quickly creates a mess on the user's finger which then spreads to the hand and then to the user's clothing.

SUMMARY OF THE INVENTION

Among the objects of the present invention are to provide an improved apparatus for dry marking and erasing, to provide such improved apparatus which allows for erasing in tight spots and small areas without erasing nearby markings, to provide such improved apparatus which is inexpensive to manufacture, and to provide such improved apparatus which is convenient to use.

In one embodiment, the invention comprises a marker and eraser system. The system includes a dry marker having a marker end for marking and a butt end opposite the marker end. A plastic cap is open at an open end, has a solid top spaced from the open end, and has a solid sidewall between the open end and the solid top. The system also includes an eraser secured to the solid top or solid sidewall of the plastic cap wherein the eraser is adapted for erasing dry erase markings. The sidewall of the cap has an internal surface dimensioned to engage the marker end of the dry marker through the open end of the cap to protect the marker end from drying out when the dry marker is not in use. The cap also engages the butt end of the dry marker to store the cap when the dry marker is in use.

In another embodiment, the invention comprises a marker and eraser system including a dry marker having a marker end for marking, a butt end opposite the marker end and a marker body extending between the marker end and the butt end. A plastic cap is open at an open end, has a solid top spaced from the open end, and has a solid sidewall between the open end and the solid top. The sidewall of the cap has an internal surface dimensioned to engage the marker end of the dry marker through the open end of the cap to protect the marker end from drying out when the dry marker is not in use. The cap also engages the butt end of the dry marker to store the cap when the dry marker is in use. The system also includes an elongated eraser secured along the marker body between the marker end and the butt end of the dry marker.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF PREFERRED EMBODIMENTS

Figure 1:
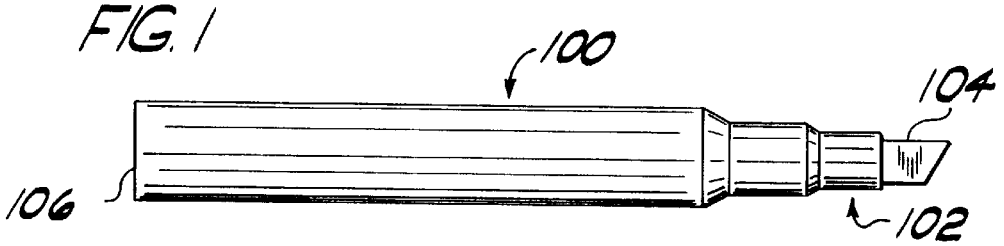
FIG. 1 shows a conventional dry marker.

FIG. 1 shows a conventional dry marker 100 having a marker end 102 which includes a marker element 104. Marker element 104 is the part of marker 100 which actually makes the mark on a white board during use of marker 100. Marker 100 has a butt end 106 opposite marker end 102.

Figure 2:
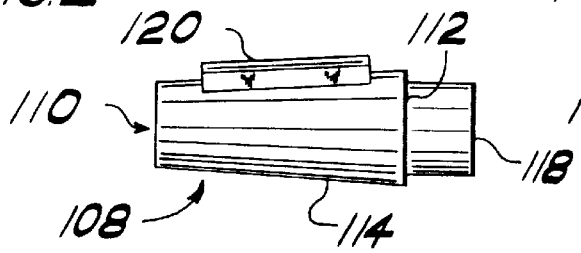
FIGS. 2 and 2A show views of a cap for a dry marker of the present invention having an eraser secured to the top and side of the cap.
Figure 2A:
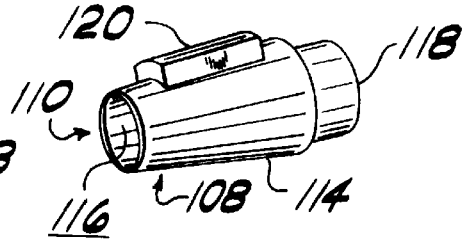

FIG. 2 shows a plastic cap 108. Cap 108 is open at an open end 110 and has a solid top 112 spaced from open end 110 by a solid sidewall 114. FIG. 2A shows a perspective view of cap 108. As seen from the view looking into open end 110, the sidewall 114 of cap 108 has an internal surface 116 dimensioned for engaging the marker end 102 of marker 100 through open end 110 to protect marker element 104 from drying out when marker 100 is not in use. Cap 108 is also adapted for engaging the butt end 106 of marker 100 for storing cap 108 when marker 100 is in use.

FIGS. 2 and 2A also show a top eraser 118 and a side eraser 120 secured to cap 108. Either eraser alone is sufficient within the scope of the invention. Both erasers 118 and 120 are illustrated in the figures to show alternate positionings on cap 108 for securing an eraser. Erasers 118 and 120 are preferably made of medium density felt such as that available from Western Felt & Fiber, 323 South Data Avenue, Alhambra, Calif. 91803 or from Pacific States Felt & Manufacturing Co., Inc., 23850 Clawiter Road, Suite #2, Hayward, Calif. 94545. Prototypes have shown that tighter woven felts tend to hold up better and "shed" less than pressed felts. The thickness of the felt is not critical so long as it is sufficiently thick to perform the erasing function. Felt erasers having a thickness in the range from ⅛ inch to ½ inch have performed well, although erasers outside of this range may be used within the scope of the invention. Other types of synthetic and natural felt, synthetic and natural sponge, cellulose, foam rubber, neoprene, cloth and similar materials may also be used to construct erasers 118 and 120.

Erasers 118 and 120 may be secured to cap 108 in several ways. Cap 108 and the body of marker 100 are commonly made of polypropylene plastic. Any adhesive or other material that sticks to polypropylene and will also stick to the eraser may be used. In practice, it has been found that hot melt plastic glue sticks available from local hardware stores work the best for holding erasers 118 and 120 to cap 108. In particular, all purpose/all temperature mini glue sticks supplied by FPC Corporation, 355 Hollow Hill Drive, Wauconda, Ill. 60084 when used in a high temperature mini glue gun, also supplied by FPC Corporation, work the best for securing a felt eraser to cap 108. Other hot melt glue sticks in other glue guns of varying temperatures can also be used within the scope of the invention. Such hot melt glue fills the spaces between the plastic and the felt to provide a solid bond between the plastic and the felt without migrating away. Such hot melt glue is also inexpensive, sets up and hardens quickly, and is nontoxic and nonflammable. Any other type of adhesive, including glues, epoxies, and related materials, may be used within the scope of the invention so long as they stick to the plastic cap 108 and/or to the marker body as discussed below.

Erasers 118 and 120 may also be secured to cap 108 with double sided tape. When using such tape, it is preferable to separately glue the eraser to one side of the tape instead of relying solely on the tape for holding the eraser to the tape. Alternatively, some felt comes with tape already attached. Such pre-taped felt is also acceptable to the extent it is capable of adhering to the body or cap of marker 100. Likewise, hook and latch fasteners (such as VELCRO) may also be taped or glued to the body or cap of marker 100 for securing an eraser. As seen in the figures below, erasers 118 and 120 may also be mechanically secured with fasteners such as pins or crimped brackets. Erasers 118 and 120 may also be secured by gluing them to a thumbtack and then sticking the thumbtack into the body or cap of the marker. A mechanical rivet may also be used to secure erasers 118 and 120 to the body or cap of the marker. Other suitable devices may also be used to secure erasers 118 and 120 to the body or cap of the marker within the scope of the invention.

Figure 3:
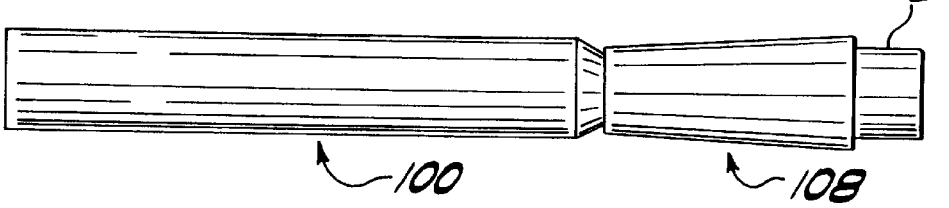
FIG. 3 shows a dry marker of the present invention with a cap covering the marker end.
Figure 4:
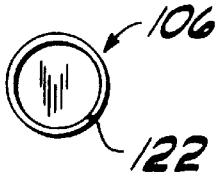
FIG. 4 shows an end view of a dry marker which engages the cap for storage when the marker is in use.
Figure 5:
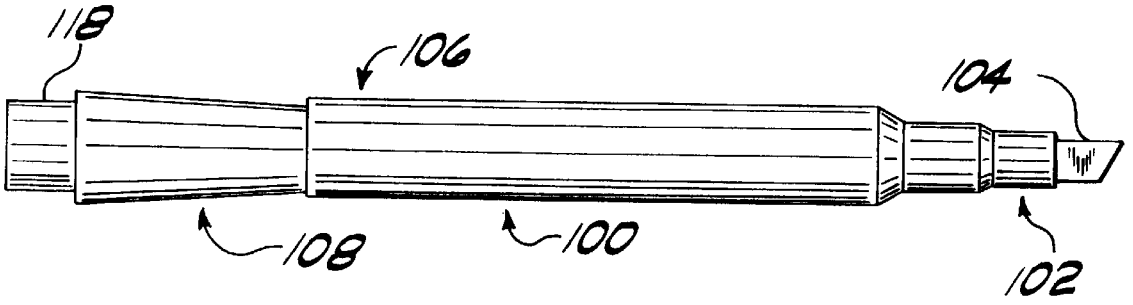
FIGS. 5 and 6 show a dry marker of the present invention ready for use.

FIG. 3 shows marker 100 with cap 108 pressed over marker end 102 to protect marker element 104 from drying out. FIG. 4 shows an end view of butt end 106 which includes a connector 122 for engaging cap 108 to store the cap during use of marker 100. FIG. 5 shows marker 100 with cap 108 pressed onto butt end 106. From these figures, it is seen that erasers 118 and 120 are accessible for erasing dry markings when cap 108 is pressed onto either the marker end or the butt end of marker 100.

Figure 6:
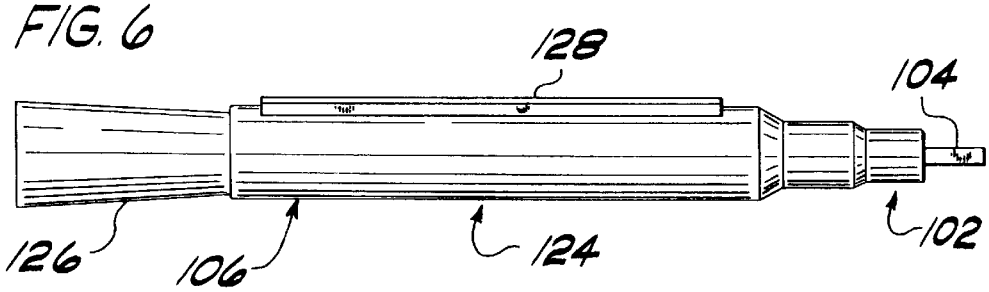
Figure 7:
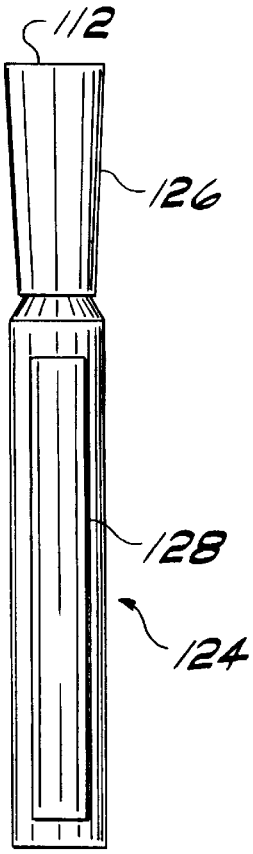
FIG. 7 shows a dry marker of the present invention with a cap covering the marker end.

FIGS. 6 and 7 show a dry marker 124 of the present invention having a cap 126 and an elongated eraser 128 secured along the marker body between the marker end 102 and the butt end 106 of marker 124. As seen, eraser 128 is accessible for erasing dry markings when the plastic cap 126 is pressed onto either the marker end or the butt end of the dry marker As shown in FIG. 6, cap 126 has been pressed onto butt end 106 for storage during use. Cap 126 can alternatively be positioned over the marker end 102 as in FIG. 7 to prevent the marker element from drying out when the marker is not in use.

As shown in FIG. 7, cap 126 is open at the end which receives the marker element, has a solid top 112 spaced from the open end, and has a solid sidewall between the open end and the solid top. As with cap 108 in FIG. 2, the sidewall of cap 126 has an internal surface dimensioned for engaging the marker end 102 of marker 124 through the open end of the cap to protect the marker end from drying out when the dry marker is not in use. As shown in FIG. 6, cap 126 is also adapted for engagement with the butt end of marker 124 for storing cap 126 when marker 124 is in use.

Eraser 128 is preferably made of medium density felt as explained above for erasers 118 and 120 shown, for example, in FIG. 2. Again, prototypes have shown that tighter woven felts tend to hold up better and "shed" less than pressed felts. The thickness of the felt is not critical so long as it is sufficiently thick to perform the erasing function. Felt erasers having a thickness in the range from ⅛ inch to ½ inch have performed well, although erasers outside of this range may be used within the scope of the invention. Other types of synthetic and natural felt, synthetic and natural sponge, cellulose, foam rubber, neoprene, cloth and similar materials may also be used to construct eraser 128.

Eraser 128 may be secured to the body of marker 124 in several ways. As explained above, cap 126 and the body of marker 124 are commonly made of polypropylene plastic. Any adhesive or other material that sticks to polypropylene and will also stick to the eraser may be used. In practice, it has been found that hot melt plastic glue sticks available from local hardware stores work the best for holding erasers 128 to the body of marker 124. In particular, all purpose/all temperature mini glue sticks supplied by FPC Corporation when used in a high temperature mini glue gun, also supplied by FPC Corporation, work the best for securing a felt eraser to marker 124. Other hot melt glue sticks in other glue guns of varying temperatures can also be used within the scope of the invention. Such hot melt glue fills the spaces between the plastic and the felt to provide a solid bond between the plastic and the felt without migrating away. Such hot melt glue is also inexpensive, sets up and hardens quickly, and is nontoxic and nonflammable. Any other type of adhesive, including glues, epoxies, and related materials, may be used within the scope of the invention so long as they stick to the cap and/or marker body.

Eraser 128 may also be secured to the body of marker 124 with double sided tape. When using such tape, it is preferable to separately glue the eraser to one side of the tape instead of relying solely on the tape for holding the eraser to the tape. Alternatively, some felt comes with tape already attached. Such pre-taped felt is also acceptable to the extent it is capable of adhering to the body of marker 124. Likewise, hook and latch fasteners (such as VELCRO) may also be taped or glued to the body of marker 124 for securing an eraser. Eraser 128 may also be mechanically secured to the body of marker 124. Eraser 128 may also be secured by gluing it to a thumbtack and then sticking the thumbtack into the body of the marker. A mechanical rivet may also be used to secure eraser 128 to the body of the marker. Other suitable devices may also be used to secure eraser 128 to the body of the marker within the scope of the invention.

Figure 8:
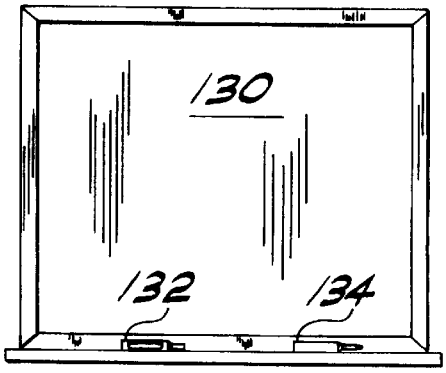
FIG. 8 shows a white board and dry markers of the present invention.

FIG. 8 shows a white board 130 and dry markers 132 and 134 of the present invention. Marker 132 is similar in construction to the marker shown in FIG. 7. Marker 134 is similar in construction to the marker shown in FIGS. 1 to 5.

Figure 9:
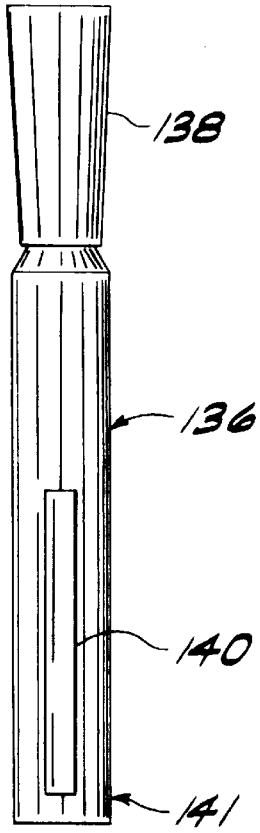
FIGS. 9 and 10 show a dry marker of the present invention with a cap covering the marker end.

FIG. 9 shows a dry marker 136 and elongated eraser 140 of the present invention where eraser 140 is secured along the body of marker 136 from a point adjacent a butt end 141 to a second point about one half of the distance between the butt end 141 and the marker end shown covered by a cap 138. By positioning eraser 140 in this way, the marker 136 is easier to handle and the eraser 140 does not interfere with the user's grip. Users can wrap their fingers around the marker without touching the eraser. This substantially eliminates any transfer of dry erase ink from the eraser to the fingers. On a standard sized marker, an eraser 5 centimeters ("cm") long by 1 cm wide and 1 cm thick has been found to work quite well. Other sizes can also be used within the scope of the invention. For erasers of shorter length, such shorter erasers can be secured along the marker body from a point adjacent the butt end to a second point at least one quarter of a distance from the butt end to the marker end.

Figure 10:
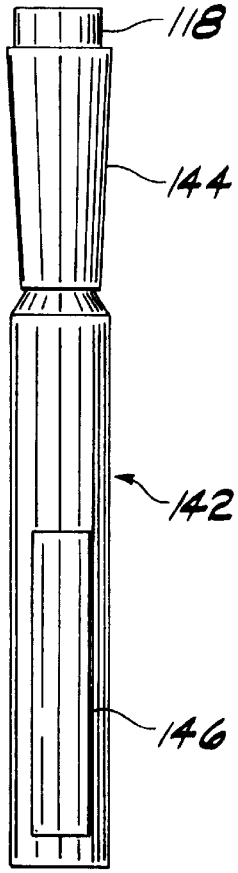

FIG. 10 shows a marker 142 which is very similar to marker 136 in FIG. 9 except that marker 142 includes a wider eraser 146 and includes an extra eraser 118 on the top of a cap 144. Since eraser 146 is wider, the user may have difficulty making small erasures amidst other markings on a white board which are not to be erased. The smaller eraser 118 is better suited for these small erasures. Erasers 140 and 146 may be secured to the bodies of markers 136 and 142, respectively, in the same manner as described above for securing eraser 128 to the body of marker 124.

Figure 11:
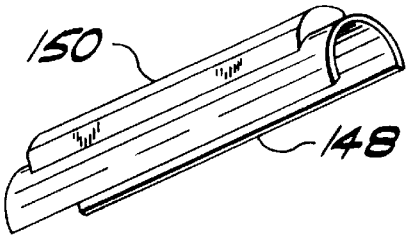
FIGS. 11 and 12 show an eraser clip for a marker of the present invention.
Figure 12:
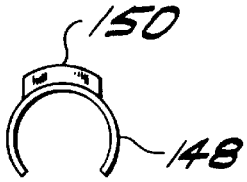
Figure 12A:
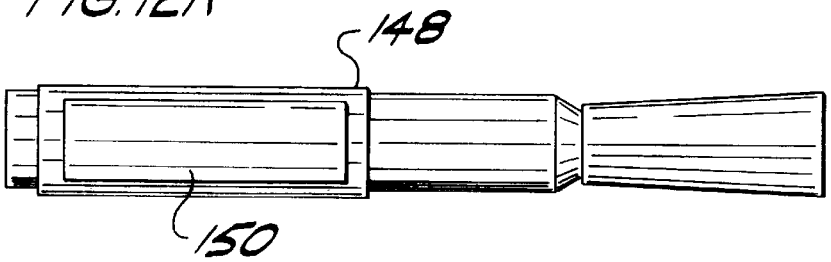
FIG. 12A shows the clip of FIGS. 11 and 12 snapped onto a dry marker.

FIGS. 11 and 12 show an eraser 150 secured to a clip 148. FIG. 11 provides a perspective view and FIG. 12 provides an end view of clip 148. As seen in FIG. 12, clip 148 has an arcuate shape so that it can be snapped onto and thus secured to the body of a conventional dry marker. FIG. 12A shows such a clip 148 secured to a marker. Clip 148 can be made from plastic, metal, or some other suitable material. Standard PVC pipe of appropriate size has been found to work quite well. It has been found helpful with plastic clips to have the arc of clip 148 slightly exceed 180 degrees for a tighter, more secure fit of the clip 148 around the marker.

Figure 13:
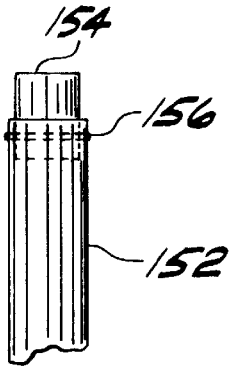
FIGS. 13 and 14 show a cap for a dry marker of the present invention having an eraser secured to the top of the cap.
Figure 14:
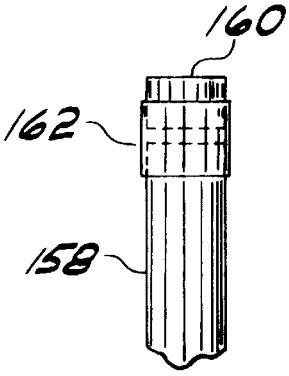

FIGS. 13 and 14 show other ways for securing an eraser to a marker cap. In FIG. 13, an eraser 154 is attached to a marker cap 152 by means of a pin 156 which extends through the cap 152, the eraser 154 and then back through the cap. In FIG. 14, an eraser 160 is attached to a marker cap 158 by means of a cylindrical fixture 162 which is crimped against the cap and the eraser to secure the eraser in position. The benefit of such cap mounted erasers is that they are available for use even when the cap is covering the marker end of the marker. Further, they work particularly well for small erasing jobs.

In practice, all of the erasers (118, 120, 128, 140, 146, 150, 154 & 160) shown in the drawings can be made from the same materials as described above for erasers 118 and 120. Thus, felt is the preferred material, but the other materials work well, too. For uses where mechanical attachment such as that shown in FIGS. 13 and 14 is not going to be used, the adhesives, hot melt glue sticks, tapes and other materials mentioned above for securing erasers 118 and 120 can be used for all of the erasures disclosed herein, although hot melt plastic glue sticks have been found to work the best.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A marker and eraser system comprising:

a dry marker having a marker end for marking, a butt end opposite the marker end and a marker body extending between the marker end and the butt end;

a plastic cap being open at an open end, having a solid top spaced from the open end, and having a solid sidewall between the open end and the solid top; and wherein the sidewall of the cap has an internal surface dimensioned for engaging the marker end of the dry marker through the open end of the cap to protect the marker end from drying out when the dry marker is not in use;

wherein the cap is adapted for engagement with the butt end of the dry marker for storing the cap when the dry marker is in use; and a dry erase eraser secured along the marker body between the marker end and the butt end of the dry marker, wherein said eraser is positioned along the marker body so as not to prevent use of the marker end of the marker for marking;

whereby the dry erase eraser is accessible for erasing dry erase markings when the plastic cap is pressed onto either the marker end or the butt end of the dry marker.

2. The marker and eraser system of claim 1 wherein the dry erase eraser is secured along the marker body from a point adjacent the butt end to a second point about one half of a distance between the butt end and the marker end.

3. The marker and eraser system of claim 1 wherein the dry erase eraser is secured along the marker body from a point adjacent the butt end to a second point at least one quarter of a distance from the butt end to the marker end.

4. The marker and eraser system of claim 1 comprising a plastic adhesive for securing the dry erase eraser to the marker body.

5. The marker and eraser system of claim 4 wherein the plastic adhesive comprises hot melt glue.

6. The marker and eraser system of claim 1 wherein the dry erase eraser comprises felt.

7. The marker and eraser system of claim 1 comprising an arcuate clip for engaging the marker body; wherein the dry erase eraser is secured to the arcuate clip.

8. The marker and eraser system of claim 7 wherein the arcuate clip is secured along the marker body from a point adjacent the butt end to a second point about one half of a distance between the butt end and the marker end.

9. The marker and eraser system of claim 7 comprising a plastic adhesive for securing the dry erase eraser to the arcuate clip.

10. The marker and eraser system of claim 9 wherein the plastic adhesive comprises hot melt glue.

11. The marker and eraser system of claim 7 wherein the dry erase eraser comprises felt.

12. A marker and eraser system comprising:

a dry marker having a marker end for marking, a butt end opposite the marker end and a marker body extending between the marker end and the butt end;

a plastic cap being open at an open end, having a solid top spaced from the open end, and having a solid sidewall between the open end and the solid top;

wherein the sidewall of the cap has an internal surface dimensioned for engaging the marker end of the dry marker through the open end of the cap to protect the marker end from drying out when the dry marker is not in use;

wherein the cap is adapted for engagement with the butt end of the dry marker for storing the cap when the dry marker is in use;

wherein the dry marker and the plastic cap form a unitary structure when the cap engages the marker end or the butt end; and a dry erase eraser secured to a portion of the unitary structure wherein said eraser is adapted for erasing dry erase markings and wherein said eraser is positioned on the unitary structure so as not to prevent use of the marker end of the marker for marking;

wherein the dry erase eraser is secured along the marker body between the marker end and the butt end of the dry marker:

whereby the dry erase eraser is accessible for erasing dry markings when the plastic cap is pressed onto either the marker end or the butt end of the dry marker.

* * * * *